US012291807B2

(12) United States Patent
Bodin et al.

(10) Patent No.: US 12,291,807 B2
(45) Date of Patent: May 6, 2025

(54) MANUFACTURING OF A WEB OF PACKAGING MATERIAL

(71) Applicant: Swedish Match North Europe AB, Stockholm (SE)

(72) Inventors: Cristian Bodin, Lerum (SE); Linnea Seiler, Partille (SE)

(73) Assignee: Swedish Match North Europe AB, Stockholm (SE)

( * ) Notice: Subject to any disclaimer, the term of this patent is extended or adjusted under 35 U.S.C. 154(b) by 833 days.

(21) Appl. No.: 17/431,585

(22) PCT Filed: Feb. 17, 2020

(86) PCT No.: PCT/EP2020/054050
§ 371 (c)(1),
(2) Date: Aug. 17, 2021

(87) PCT Pub. No.: WO2020/169513
PCT Pub. Date: Aug. 27, 2020

(65) Prior Publication Data

US 2022/0145502 A1 May 12, 2022

(30) Foreign Application Priority Data

Feb. 19, 2019 (SE) ..... 1950206-1

(51) Int. Cl.
*D04H 1/541* (2012.01)
*A24F 23/02* (2006.01)
(Continued)

(52) U.S. Cl.
CPC ..... *D04H 1/5418* (2020.05); *A24F 23/02* (2013.01); *B65B 9/10* (2013.01); *D04H 1/5412* (2020.05); *D04H 1/542* (2013.01); *D04H 1/74* (2013.01)

(58) Field of Classification Search
CPC ..... A24F 23/02
See application file for complete search history.

(56) References Cited

U.S. PATENT DOCUMENTS 5,422,159 A * 6/1995 Fagan ..... D04H 1/492 28/103
2002/0004351 A1* 1/2002 Nobbee ..... D01F 6/30 442/394

(Continued)

FOREIGN PATENT DOCUMENTS

CN 105365025 12/2015
CN 105 365 025 A 3/2016

(Continued)

OTHER PUBLICATIONS

International Search Report and Written Opinion were mailed on May 7, 2020 by the International Searching Authority for International Application No. PCT/EP2020/054050, filed on Feb. 17, 2020 and published as WO 2020/169513 on Aug. 27, 2020 (Applicant—Swedish Match North Europe AB) (10 Pages).

(Continued)

*Primary Examiner* — Joshua G Kotis
(74) *Attorney, Agent, or Firm* — Ballard Spahr LLP

(57) ABSTRACT

Disclosed is an arrangement and a method for manufacturing of a web of packaging material for an oral pouched snuff product. The web is a saliva-permeable nonwoven web includes fibres, whereof 0%-95% of said fibres are of a first type and 5%-100% of a second type, the fibres of the first type being cellulose-based staple fibres, and the fibres of the second type being thermoplastic fibres, which are meltable and/or softenable at least at the surface. The arrangement includes a carding unit for carding the fibres to form a pre-web, an air-through bonding unit for bonding the pre-web by means of at least partial melting and/or softening of (Continued)

the fibres of the second type to form the web, and a calendering unit for surface treatment of the web.

18 Claims, 2 Drawing Sheets

(51) Int. Cl.

| | |
|---|---|
| ***B65B 9/10*** | (2006.01) |
| ***D04H 1/542*** | (2012.01) |
| ***D04H 1/74*** | (2006.01) |

(56) References Cited

U.S. PATENT DOCUMENTS

| | | | | |
|---|---|---|---|---|
| 2002/0026177 | A1* | 2/2002 | Lochte | A61F 13/26 28/118 |
| 2008/0078152 | A1 | 4/2008 | Smithies | |
| 2008/0085649 | A1* | 4/2008 | Salamero | B41F 35/006 442/327 |
| 2008/0237911 | A1* | 10/2008 | Ardiff | D03D 15/283 428/296.7 |
| 2009/0258559 | A1* | 10/2009 | Anantharamaiah | D04H 1/74 442/334 |
| 2010/0206505 | A1* | 8/2010 | Clarahan | D21F 11/145 162/290 |
| 2011/0303511 | A1 | 12/2011 | Brinkley et al. | |
| 2011/0311795 | A1* | 12/2011 | Bartl | D04H 3/007 428/221 |
| 2012/0031416 | A1 | 2/2012 | Atchley et al. | |
| 2012/0051672 | A1* | 3/2012 | Foss | B65D 85/808 383/105 |
| 2012/0103353 | A1 | 5/2012 | Sebastian et al. | |
| 2012/0167901 | A1* | 7/2012 | Onno | A24B 13/00 131/111 |
| 2014/0072767 | A1* | 3/2014 | Klaska | D04H 3/10 428/156 |
| 2015/0189910 | A1 | 7/2015 | Sebastian et al. | |
| 2015/0240390 | A1* | 8/2015 | Yakake | D04H 1/43828 442/364 |
| 2016/0073689 | A1 | 3/2016 | Sebastian et al. | |
| 2017/0281425 | A1 | 10/2017 | Herfert et al. | |
| 2018/0125116 | A1* | 5/2018 | Cooper | A24F 23/02 |
| 2018/0153211 | A1* | 6/2018 | Persson | B29C 66/73921 |
| 2018/0327975 | A1* | 11/2018 | Nordstrom | B65D 75/44 |
| 2019/0145032 | A1* | 5/2019 | Mohr | D01F 8/06 442/364 |
| 2020/0253268 | A1* | 8/2020 | Rousseau | A24D 1/022 |
| 2021/0386112 | A1* | 12/2021 | Accou | A24D 1/02 |

FOREIGN PATENT DOCUMENTS

| | | |
|---|---|---|
| EP | 0 835 339 | 4/1998 |
| KR | 19990076630 | 10/1999 |
| KR | 20110000756 | 1/2011 |
| WO | WO199724482 | 7/1997 |
| WO | WO 2008/016770 | 2/2008 |
| WO | WO2009142315 | 11/2009 |
| WO | WO 2016/090075 | 6/2016 |

OTHER PUBLICATIONS

International Preliminary Report on Patentability was mailed on May 12, 2021 by the International Searching Authority for International Application No. PCT/EP2020/054050, filed on Feb. 17, 2020 and published as WO 2020/169513 on Aug. 27, 2020 (Applicant—Swedish Match North Europe AB) (27 Pages).

"What is through air bonding" on WPT Nonwovens Corporation, Posted Jun. 5, 2018, Retrieved from the internet: URL: https://www.wptnonwovens.com/blog/blog-what-is-through-air-bonding/.

Swedish Search Report was mailed on Sep. 11, 2019 by the Swedish Patent Office for Swedish Application No. 1950206-1 filed on Feb. 19, 2019 (Applicant—Swedish Match North Europe AB) (8 pages).

* cited by examiner

MANUFACTURING OF A WEB OF PACKAGING MATERIAL

CROSS-REFERENCE TO RELATED APPLICATIONS

This application is a U.S. National Phase Application of International Application No. PCT/EP2020/054050, filed Feb. 17, 2020, which claims priority to Swedish Application No. 1950206-1, filed Feb. 19, 2019, each of which are hereby incorporated by reference in their entirety.

TECHNICAL FIELD

The present disclosure relates to an arrangement and a method for manufacturing of a web of packaging material for an oral pouched snuff product.

BACKGROUND

Smokeless tobacco products for oral use are made from tobacco leaves, such as lamina and stem of the tobacco leaf. The material from roots and stalks are normally not utilized for production of smokeless tobacco compositions for oral use.

Smokeless tobacco for oral use includes chewing tobacco, dry snuff and moist (wet) snuff. Generally, dry snuff has moisture content of less than 10 wt % and moist snuff has a moisture content of above 40 wt %. Semi-dry products having between 10% to 40 wt % moisture content are also available.

There are two types of moist snuff, the American type and the Scandinavian type. The Scandinavian type of moist snuff is also called snus. American-type moist snuff is commonly produced through a fermentation process of moisturized ground or cut tobacco. Scandinavian-type moist snuff (snus) is commonly produced by using a heat-treatment process (pasteurization) instead of fermentation. Both processes reduce the bitterness of unprocessed tobacco and also soften the texture of the tobacco being the primary reasons why not unprocessed tobacco is used for the production of moist snuff. The heat-treatment is also carried out in order to degrade, destroy or denature at least a portion of the micro-organisms within the tobacco preparation.

Both the American-type and the Scandinavian-type of moist snuff for oral use are available in loose form or portion-packed in a saliva-permeable, porous wrapper material forming a pouch. Pouched moist snuff, including snus, is typically used by the consumer by placing the pouch between the upper or lower gum and the lip and retaining it there for a limited period of time. The pouch material holds the tobacco in place while allowing saliva to pass into the tobacco and allowing flavours and nicotine to diffuse from the tobacco material into the consumer's mouth.

The pouch material used in oral pouched snuff products, also called the packaging material, is a saliva-permeable nonwoven. Nonwovens are fabrics that are neither woven nor knitted.

A carded web is an example of a dry-laid nonwoven. If carded, the manufacturing process may result in fibres substantially being oriented in the carding direction. Dry-laid nonwoven may comprise parallel laid web, cross laid webs or randomly laid webs. Parallel laid webs and cross laid webs normally include two or more superimposed web layers, which normally are carded, while randomly laid webs normally include a single web layer, which may be airlaid.

According to known technology, several different methods may be used to bond together the fibres in the web, also called web consolidation. The different types of bonding methods may be classified as mechanical bonding, e.g. needle punching, stitch bonding, hydro-entanglement, as chemical bonding, e.g. saturation bonding, spray bonding, foam bonding, powder bonding, print bonding and as thermal bonding, e.g. point-bonding in a hot calendar. More than one bonding method may be used to consolidate the nonwoven. In chemical bonding, a binder, also called bonding agent or adhesive, is combined with the fibres. This type of nonwoven is generally called chemically bonded or adhesive bonded nonwoven.

Pouched smokeless tobacco products for oral use may be post-moisturized after pouch formation or not post-moisturized after pouch formation. Pouched smokeless tobacco products for oral use which are not post-moisturized is herein referred to as non-post-moisturized. Post-moisturized pouched products may be produced by spraying water on the pouched smokeless tobacco product before packaging the pouched products in cans. The moisture content of the final oral pouched smokeless tobacco product comprising moist or semi-dry snuff is normally within the range of from 25 to 55% w/w based on the weight of the pouched product (i.e. the total weight of moist snuff and pouch material).

There are also smokeless non-tobacco products for oral use, which do not contain any tobacco material. Instead, the oral smokeless non-tobacco product comprises non-tobacco plant material and/or a filling material.

Addition of a small amount of tobacco to the oral smokeless non-tobacco product provides an oral smokeless low tobacco snuff product. Thus, in addition to a small amount of tobacco the oral smokeless snuff product comprises non-tobacco plant material as described herein and/or a filling material as described herein.

Examples of nicotine-free moist non-tobacco snuff products for oral use and the manufacture thereof are provided in WO 2007/126361 and WO 2008/133563. This type of non-tobacco snuff product for oral use may be provided in loose form or portion-packed in a saliva-permeable, porous wrapper material forming a pouch.

For nicotine-containing oral smokeless non-tobacco products, or oral smokeless low tobacco snuff products which contain nicotine in addition to the nicotine provided by the tobacco in said product, the nicotine may be synthetic nicotine and/or nicotine extract from tobacco plants. Further, the nicotine may be present in the form of nicotine base and/or a nicotine salt.

The oral smokeless non-tobacco product or the oral smokeless low tobacco snuff product may be dry, semi-dry or moist. Generally, dry oral smokeless non-tobacco products or dry oral smokeless low tobacco snuff products have a moisture content of less than 10 wt % and moist oral smokeless non-tobacco products or moist oral smokeless low tobacco snuff products have a moisture content of above 40 wt %. Semi-dry oral smokeless non-tobacco products or semi-dry oral smokeless low tobacco snuff products have a moisture content between 10 wt % and 40 wt %.

The oral smokeless non-tobacco products or oral smokeless low tobacco snuff product may be flavourized by mixing the flavour with the oral smokeless non-tobacco product components or the oral smokeless snuff product components during manufacturing. Additionally or alternatively, the flavour may be added to the oral smokeless non-tobacco product or oral smokeless snuff product after it has been manufactured.

Pouched smokeless tobacco products may be produced by measuring portions of the smokeless tobacco composition and inserting the portions into a nonwoven tube.

U.S. Pat. No. 4,703,765 discloses a device for packaging precise amounts of finely divided tobacco products, such as snuff tobacco or the like, in a tubular packaging material into which snuff portions are injected via a fill tube. Downstream from the tube, welding means are positioned for transverse sealing of the packaging material, and also cutting means for severing the packaging material in the area of the transverse seal to thus form discrete or individual portion packages.

Pouched smokeless tobacco products may alternatively be produced by placing portions of moist snuff on a nonwoven web using a pouch packer machine in accordance with the device disclosed in U.S. Pat. No. 6,135,120.

The individual portions are sealed and cut apart thereby forming rectangular "pillow shaped" (or any other desired form) pouched products. Generally, each final pouched product includes parallel transverse seals at opposite ends and a longitudinal seal orthogonal to the transverse seals. The seals must be of sufficient strength to preserve the integrity of the pouched product during use while not disturbing the consumer's experience.

Oral pouched smokeless tobacco products are normally sized and configured to fit comfortably and discreetly in a user's mouth between the upper and lower gum and the lip.

When manufacturing a packaging material for an oral pouched product, there is typically a trade-off between strength and comfort when placed in the buccal cavity of the user. The packaging material forms the outside of the pouched product and is hence in contact with the buccal cavity, typically between the teeth and gum. The strength of the packaging material should desirably be high enough to handle the packaging material during manufacturing of the packaging material itself, during manufacturing of the pouched product and for the pouched product in use in the buccal cavity. Thereby, it is important that the seals of the pouched product are strong enough. Yet the packaging material should desirably be flexible enough to be comfortable when the oral pouched snuff product is placed in the buccal cavity of the user. Commonly used packaging material may often suffer from having a seal strength of the pouched product being less than desirable, especially when exposed to aggressive flavours comprised in the smokeless tobacco composition or non-tobacco composition enclosed by the packaging material in the pouched product.

It may further be desirable that the oral pouched snuff product is experienced as soft in the mouth. Moreover, it may be desirable that the packaging material is experienced as less slippery in the mouth as compared to commonly used packaging materials for oral pouched snuff products.

The object of the present invention is to overcome or at least mitigate some of the problems associated with the prior art.

Definitions

By "tobacco" is meant any part, e.g. leaves, stems, and stalks, of any member of the genus *Nicotiana*. The tobacco may be whole, shredded, threshed, cut, ground, cured, aged, fermented, or treated in any other way, e.g. granulated or encapsulated.

The term "tobacco snuff composition" is used herein for a finely divided tobacco material such as a ground tobacco material or cut tobacco. In addition to the tobacco material, the tobacco snuff composition may further comprise at least one of the following: water, salt (e.g. sodium chloride, potassium chloride, magnesium chloride, calcium chloride and any combinations thereof), pH adjuster, flavouring agent, cooling agent, heating agent, sweetening agent, colorant, humectant (e.g. propylene glycol or glycerol), antioxidant, preservative (e.g. potassium sorbate), binder, disintegration aid. In an example, the smokeless snuff composition comprises or consists of finely divided tobacco material, salt such as sodium chloride, and a pH adjuster. The tobacco snuff composition may be dry or moist. The tobacco snuff composition may be used between the teeth and gum.

A "non-tobacco composition" is a composition which does not contain any tobacco material, and which may be used in a similar way or in the same way as a tobacco snuff composition. Instead of tobacco, the non-tobacco composition may contain non-tobacco plant fibres and/or a filling material. Also processed fibres such as Microcrystalline Cellulose fibres may be used. The filling material may be present in the form of particles. For instance, the filling material may be a particulate filling material such as particles of microcrystalline cellulose. The non-tobacco composition may contain nicotine, i.e. it may be a nicotine-containing non-tobacco composition. Alternatively, the non-tobacco composition may contain no nicotine or substantially no nicotine, i.e. it may be a nicotine-free non-tobacco composition. As used herein, the expression "substantially no nicotine" intends an amount of nicotine of 1 percent by weight or less based on the total dry weight of the composition.

"Oral" and "oral use" is in all contexts used herein as a description for use in the oral cavity, such as buccal placement. The product is then intended for placement within the oral cavity, such as between the gum and the upper or lower lip, such that the product as a whole is contained in the oral cavity. The product is not intended to be swallowed.

As used herein "pouched product" or "oral pouched product" refers to a portion of smokeless tobacco composition or non-tobacco composition packed in a saliva-permeable pouch material intended for oral use, such as by buccal placement in the oral cavity. The oral pouched product may alternatively be referred to as a portion-packed (pouched) product for oral use.

As used herein, the term "moisture content" refers to the total amount of volatile ingredients, such as water and other oven volatiles, e.g. propylene glycol and ethanol, in the composition or product referred to. The moisture content is given herein as percent by weight (wt %), i.e. weight percent of the component referred to based on the weight of the total composition, preparation or product referred to.

"Flavour" or "flavouring agent" is used herein for a substance used to influence the aroma and/or taste of the smokeless tobacco product, including, but not limited to, essential oils, single flavour compounds, compounded flavourings, and extracts.

SUMMARY

The object of the present disclosure is to overcome or ameliorate at least one of the disadvantages of the prior art, or to provide a useful alternative.

The object above may be achieved by the subject-matter of the present application. Embodiments are set forth in the appended dependent claims, in the following description and in the drawings.

The present invention relates to an arrangement for manufacturing of a web of packaging material for an oral pouched snuff product, the web being a saliva-permeable nonwoven web comprising fibres, whereof 0%-95% of said fibres are of a first type and 5%-100% of a second type, with % numbers being determined as % of total fibre weight at 21° C. and 50% RH, the fibres of the first type being cellulose-based staple fibres, and the fibres of the second type being thermoplastic fibres, which are meltable and/or softenable at least at the surface. The arrangement comprises a carding unit for carding the fibres to form a pre-web, an air-through bonding unit for bonding the pre-web by means of at least partial melting and/or softening of the fibres of the second type to form the web, and a calendering unit for surface treatment of the web.

The fibres of the first type may be supplied by a first fibre supply unit of the type known by the skilled person. The fibres of the second type may be supplied by a second fibre supply unit of the type known by the skilled person. Normally, the fibres are detached from each other before reaching the carding unit. If utilizing fibres of both the first type and the second type, the fibres of the two types are advantageously mixed with each other before being supplied to the carding unit, such that they are carded together.

The carding unit may comprise one or more scrambler rollers, which are utilized to make the pre-web less anisotropic.

The carded pre-web is bonded in the air-through bonding unit by means of at least partial melting and/or softening of the fibres of the second type to form a web. Thereby the at least partially melted and/or softened fibres of the second type bind the fibres together to form a cohesive web, such that a bonded web is formed. Hence, there is no need to add an additional binder to the packaging material as is known from prior art.

In the bonded web of the packaging material, the fibres still maintain their shape and structure. There is, hence, no film formed in the packaging material, which would have been the expected result if the fibres of the second type had melted more or less completely. The desired degree of melting is a balance between tensile strength, which increases with the degree of melting, and the appearance of the oral pouched snuff product and the function of the oral pouched snuff product in the buccal cavity. Purely as an example, a too melted packaging material may function less well for the oral pouched snuff product, since it could be too dense, like a film, and thus not sufficiently saliva permeable.

By utilizing that the fibres of the second type are able to at least partially melt and/or soften, there is no need to have an additional binder in the packaging material produced in the arrangement according to the invention, and/or produced with the method according to the invention described below, which is the case for commonly used packaging materials for oral pouched snuff products. Neither is the packaging material bonded by hydroentangling or point-bonding as is common in prior art. Not to be bound by any theory, it is believed that when the present packaging material is subjected to a pulling force, the fibres hook on to each other due to the at least partial melting or softening and thereby become at least partly stuck to each other, such that forces can be transferred from one fibre to an adjacent or crossing fibre. Accordingly, the packaging material is sufficiently strong without an additional binder.

The fibres of the first type, which may be dispensed with, are cellulose-based staple fibres, typically man-made fibres, e.g. regenerated cellulose fibres, such as rayon, lyocell or viscose. Tencel is a brand name for lyocell.

The fibres of the first type may be selected to give the packaging material desired mechanical properties, such that the packaging material is easy to handle during manufacturing of the packaging material itself and during manufacturing of the oral pouched snuff product, and yet is comfortable when the oral pouched snuff product is placed in the buccal cavity of the user, the packaging material then forming the outside of the product. Accordingly, the fibres of the first type may be selected to be soft, relatively inelastic and/or moisture absorbent. The relative inelasticity makes the packaging material easy to handle during manufacturing of the packaging material itself and/or during manufacturing of the oral pouched snuff product and the softness and moisture absorbency provide comfort in the buccal cavity of the user. Further, the fibres of the first type may be selected to be hydrophilic, which is advantageous when used for an oral pouched snuff product.

The fibres of the second type are selected, such that the fibres of the second type, at least at the surface of the fibres, are able to melt and/or soften. The fibres of the second type may be selected to have a pre-selectable level of strength, a pre-selectable linear density and/or a pre-selectable shape, e.g. trilobal. Further, the fibres of the second type may as an option be crimped. The fibres of the second type may thus be selected to give the packaging material a desirable level of tensile strength and/or seal strength. In particular, the fibres of the second type make it possible to obtain a high seal strength, also in wet conditions. Moreover, the fibres of the second type may also be selected to have a high seal strength when exposed to flavours. The use of the above-mentioned one or more scrambler rollers may also contribute to obtaining a desired tensile strength and/or seal strength.

The fibres of the second type are thermoplastic fibres, which are meltable and/or softenable at least at the surface at the temperatures used in the arrangement. The fibres of the second type may comprise a first component and a second component, the second component having a lower melting temperature than the first component. In that case, it is preferably the second component that at least partly melts or softens to obtain the advantages described herein. It would also be feasible to have fibres comprising three or more different components. Further, at least one of the components of the fibres of the second type may be a mixture of different polymers. The fibres of the second type may be bi-component fibres. The bi-component fibres preferably are sheath-core fibres, but other arrangements such as "side-by-side" or "islands-in-the-sea" would also be feasible. As an alternative or a complement, the fibres of the second type may be mono-component fibres, for which the whole fibre is meltable and/or softenable.

By utilizing the arrangement and/or the method as described herein, it is possible to manufacture a packaging material for an oral pouched snuff product having appropriate strength both for the material and the seals and which yet is flexible enough to be comfortable when the oral pouched snuff product is placed in the buccal cavity of the user.

This flexibility of the packaging material may be reflected in oral pouched snuff products having a lower density and a higher volume than prior art products using common packaging materials for oral pouched snuff products.

The oral pouched snuff product, comprising the packaging material manufactured with the arrangement and/or the method as described herein, may be experienced as softer in the mouth as compared to an oral pouched snuff product with packaging material manufactured according to prior art. Not to be bound by any theory, this is believed to be a result of the absence of a binder, which is commonly used in manufacturing of prior art packaging materials for oral pouched snuff products.

Moreover, the strength of the packaging material and the strength of the seals will resist aggressive flavours, e.g. methyl salicylate, better than commonly used packaging materials for oral pouched snuff products. Such flavours are known to be able to reduce seal strength, especially over time, for conventional pouched snuff products.

Further, the packaging material manufactured with the arrangement and/or the method as described herein may be experienced as less slippery in the mouth as compared to commonly used packaging materials for oral pouched snuff products. Not to be bound by any theory, also this is believed to be a result of the absence of a binder, which is commonly used in prior art packaging materials for oral pouched snuff products.

If the oral pouched snuff product is post-moisturized, an oral pouched snuff product with the packaging material manufactured with the arrangement and/or the method as described herein may have a more even colour as compared to commonly used packaging materials for oral pouched snuff products. Also this is believed to be a result of the absence of a binder, which commonly is hydrophobic. In particular, this effect may be achieved if the fibres of the second type are PLA/coPLA fibres, e.g. with PLA in the core and coPLA in the sheath.

The fibres of the first type typically make up 5%-50% of the total weight, preferably 10%-40% of the total weight or 15%-30% of the total weight of all the fibres of the packaging material. The fibres of the second type typically make up 50%-95% of the total weight, preferably 60%-90% of the total weight or 70%-85% of the total weight of all the fibres of the packaging material. The weights are defined at 21° C. and 50% RH. It is also feasible to use 0% of the fibres of the first type, i.e. to completely dispense with the fibres of the first type. It is thus feasible to use up to 100% of the fibres of the second type, e.g. to only use fibres of the second type and none of the first.

As mentioned above, it is preferred that the packaging material manufactured with the arrangement and/or the method as described herein does not comprise any binder or other kind of adhesive. The packaging material may consist of the fibres of the first type, the fibres of the second type and, optionally, fibres of any other thermoplastic fibre type, such as a thermoplastic bi-component fibre. Hence, in some embodiments, the packaging material may consist of only the fibres of the first type and the fibres of the second type. There may be no other constituent added during manufacturing of the packaging material. The packaging material may consist of the fibres of the second type and, optionally, fibres of any other thermoplastic fibre type, such as a thermoplastic bi-component fibre.

The arrangement may comprise a pre-bonding unit being located before the air-through bonding unit but after the carding unit. The pre-bonding unit may be configured to blow air through the carded pre-web at a temperature being within the range of 80° C.-155° C., preferably 90° C.-140° C., more preferably 100° C.-135° C., most preferably 110° C.-130° C. The temperature is selected depending on the melting temperatures of the fibres of the first and second types, such that the temperature in the pre-bonding unit preferably is less than the melting temperatures of fibres of both the first and second type. The pre-bonding unit is an optional unit which may be dispensed with.

The temperature of the air in the air-through dryer is chosen in relation to the running-through time and/or air flow. Purely as an example, it is possible to have a lower temperature if the running-through time is longer and/or the air flow is lower. The air flow depends on the air speed and how large an air volume is feasible to send through the air-through dryer.

The air-through bonding unit may comprise or be constituted by a flat air-through dryer. The flat air-through dryer may comprise as a single zone or in the range of from 2 to 10 zones, such as from 3 to 8 zones. If utilizing a flat air-through dryer, the pre-bonding unit, mentioned as an option herein, may be dispensed with. Instead, one or more of the first zones of the flat air-through dryer may be utilized for pre-bonding. There may also be a sliding scale from pre-bonding to air-through bonding in the flat air-through dryer by selecting the temperatures of individual zones.

The flat air-through dryer may be configured to blow air through the pre-web at a temperature being within the range of 100° C.-160° C., preferably 110° C.-150° C., more preferably 120° C.-150° C., most preferably 120° C.-140° C.

As an alternative or a complement, the air-through bonding unit may comprise or be constituted by a cylinder air-through dryer. The cylinder air-through dryer may advantageously be combined with the pre-bonding unit mentioned above, which in that case is to be located before, i.e. upstream of, the cylinder air-through dryer.

The cylinder air-through dryer may be configured to blow air through the pre-web at a temperature being within the range of 100° C.-160° C., preferably 115° C.-155° C., more preferably 120° C.-150° C., most preferably 130° C.-150° C.

It is further feasible to combine a flat air-through dryer with a cylinder air-through dryer, e.g. by utilizing a flat air-through dryer with a single zone or a few zones, such as 2-3 zones, followed by the cylinder air-through dryer. In that case, one or more of the zones of the flat air-through dryer may be utilized for pre-bonding. There may also be a sliding scale from pre-bonding to air-through bonding in the flat air-through dryer.

In order for the cylinder air-through dryer to operate in an appropriate way, the intermediate web should preferably be self-supporting when reaching the cylinder air-through dryer. In the flat air-through dryer on the other hand, the intermediate web is typically supported by a machine element, such as a fabric or belt, such that also a non-self-supporting web can be handled.

After, i.e. downstream of, the air-through bonding unit, there is a calendering unit for surface treatment of the web. The calendering is performed to obtain a pre-selectable thickness and/or surface finish and/or air permeability of the web. Hence, in the arrangement according to the invention, the calendering unit is not utilized to obtain bonding of the web. Instead the web is already sufficiently bonded when reaching the calendering unit. The calendering unit may be configured to operate at a surface treatment temperature being within the range of 45° C.-120° C., preferably 50° C.-110° C., more preferably 55° C.-100° C., most preferably 55° C.-70° C. Further, the calendering unit may be configured to operate at a pressure being within the range of 5-70 $kg/cm^2$, preferably 15-60 $kg/cm^2$, more preferably 20-50 $kg/cm^2$, most preferably 25-40 $kg/cm^2$. The air permeability may be selected to be ≤7500 $l/m^2/s$, preferably ≤4300 $l/m^2/s$, more preferably ≤2900 $l/m^2/s$, most preferably ≤2000 $l/m^2/s$, when measured according to the test method WSP070.1.R3 (12) specified by EDANA, i.e. the European Disposables and Nonwovens Association.

There are two principally different ways of running the calendering unit. A first way may be to use a high temperature and a low nip pressure. A second way may be to use a low temperature and a high nip pressure. These two ways may also be combined by using a middle temperature with a middle nip pressure. However, even if using a high temperature, the temperature should preferably be selected such that the fibres of the second type do not melt or soften. In principle, there should preferably be no or substantially no bonding of the web in the calendering unit. Instead all the bonding or at least substantially all the bonding of the web should occur in the air-through bonding unit and possibly in the pre-bonding unit, if any.

The calendering unit may comprise at least one roller having a smooth surface, e.g. a smooth steel surface. Moreover, the calendering unit may comprise or be constituted by a pair of rollers having smooth surfaces, preferably the rollers having smooth steel surfaces. Such rollers provide the desired surface treatment of the packaging material. As mentioned above, the calendering unit is used for surface treatment of the web. Accordingly, the rollers are in the arrangement according to the invention not used to obtain point-bonding, a technique known from other fields of nonwoven manufacturing.

The arrangement may further comprise additional units of the types known by the skilled person within the field of nonwoven. There may e.g. be a fine opener, i.e. a unit for breaking up fibre chunks, before the carding unit. The calendering unit may be followed by a winding unit and/or a slitting unit.

The arrangement may further comprise a supplying unit for supplying a smokeless tobacco composition or non-tobacco composition to the web, e.g. as portions, and a tube-forming unit for forming the web into a tubular structure, the tube-forming unit being located before or after the supplying unit.

In the tube-forming unit, the web is formed into the tubular structure, which is configured to enclose the smokeless tobacco composition or non-tobacco composition. The tubular structure has a width suitable for the oral pouched snuff product. The terms tube and tubular structure are herein used in a general meaning and do not imply that the cross-section has to be round. Instead any arbitrary cross-section is possible as long as the web is able to enclose the smokeless tobacco composition or non-tobacco composition and there is room for the smokeless tobacco composition or non-tobacco composition within the tubular structure. The tube-forming unit may e.g. comprise a folding unit folding the web to the tubular structure.

The arrangement may further comprise a longitudinal sealing unit for fixing the web of packaging material into a tubular shape by making at least one longitudinal seal. Hence, the longitudinal sealing unit may be used for fixing the tubular structure of the web of packaging material into the tubular shape by making at least one longitudinal seal. The longitudinal sealing unit is thus used to make a longitudinal seal in the above-mentioned tubular structure formed in the tube-forming unit. The longitudinal sealing unit may e.g. be a heat-sealing unit or an ultrasonic sealing unit.

In the longitudinal sealing unit, energy is applied to create a seal in the nonwoven web by at least partial melting of the fibres of the second type. If the fibres of the second type comprise a first and a second component as mentioned above, at least the second component melts during sealing, and preferably both the first and the second component melt. The seal is preferably located outside the smokeless tobacco composition or non-tobacco composition, such that the seal is formed between two nonwoven surfaces being placed next to each other, in contact surface to surface.

If the tube-forming unit and the longitudinal sealing unit are located before the supplying unit, the smokeless tobacco composition or non-tobacco composition may be fed, e.g. as portions, into an already formed and sealed tubular structure by the supplying unit.

In an alternative arrangement, the supplying unit may be located before the tube-forming unit and the longitudinal sealing unit, such that the smokeless tobacco composition or non-tobacco composition first is placed on the web, e.g. as portions, and thereafter the tubular structure is formed around the smokeless tobacco composition or non-tobacco composition. The web may e.g. be longitudinally folded around the smokeless tobacco composition or non-tobacco composition.

As an alternative to the tube-forming unit being the above-mentioned folding unit, the tubular structure may instead be formed by a second saliva-permeable nonwoven web being positioned on top of a first saliva-permeable nonwoven web such that one or more tubular structures are formed between the two webs. Also in that case, the supplying unit may be located either downstream or upstream of the tube-forming unit and the longitudinal sealing unit.

The arrangement may further comprise a transverse sealing unit for forming the web of packaging material into individual products by making at least one transverse seal between two consecutive individual products formed by the web, the transverse sealing unit preferably being a heat-sealing unit or an ultrasonic sealing unit.

The individual products may be separated or made separable from each other along a separation line, e.g. by cutting or perforation in a separation unit, which may be combined with the transverse sealing unit, e.g. as disclosed in WO 2017/093486 A1.

If only a single transverse seal is formed between two consecutive individual products along the web, the cut or perforation is preferably made within that transverse seal, such that both the adjacent ends of the consecutive products are sealed simultaneously.

The present invention also relates to a method for manufacturing of a web of packaging material for an oral pouched snuff product, the web being a saliva-permeable nonwoven web comprising fibres, whereof 0%-95% of the fibres are of a first type and 5%-100% of the fibres are of a second type, with % numbers being determined as % of total fibre weight at 21° C. and 50% RH, the fibres of the first type being cellulose-based staple fibres, and the fibres of the second type being thermoplastic fibres, which are meltable and/or softenable at least at the surface. The method comprises:

a) carding the fibres to form a pre-web, b) bonding the pre-web by blowing air through the pre-web to at least partially melt and/or soften the fibres of the second type to form the web of packaging material, and c) smooth calendering of the web.

The advantages obtained by the method are the same as already described above for the arrangement. The method is preferably performed in the arrangement described herein.

Before carding, the fibres are supplied. The fibres of the first type may be supplied by a first fibre supply unit of the type known by the skilled person. The fibres of the second type may be supplied by a second fibre supply unit of the type known by the skilled person. Normally, the fibres are detached from each other before reaching the carding unit. If utilizing fibres of both the first type and the second type, the fibres of the two types are advantageously mixed with each other before carding, such that they are carded together.

The method may comprise an optional step of pre-bonding the pre-web formed by carding in step a). The pre-bonding is performed before the step b) of air-through bonding. The pre-bonding may be performed in a pre-bonding unit, as described above. The pre-bonding may be performed at a temperature being within the range of 80° C.-155° C., preferably 90° C.-140° C., more preferably 100° C.-135° C., most preferably 110° C.-130° C. The temperature interval is selected dependent on the melting temperatures of the fibres of the first and second types, such that the temperature in the pre-bonding is less than their respective melting temperatures. The pre-bonding is an optional step which may be dispensed with.

In case the fibres of the second type are thermoplastic fibres comprising a first component and a second component as described above, wherein the second component has a lower melting temperature than the first component, step b) preferably comprises bonding the web by at least partially melting and/or softening of the second component of the fibres of the second type.

In the air-through bonding of step b), the fibres of the second type melt or soften and bind the fibres together to form a cohesive web, such that the web is formed. If the fibres of the second type are the above-mentioned thermoplastic fibres comprising a first and a second component, the second component partially melts or softens to bind the fibres together to form a cohesive web.

The air-through bonding of step b) may be performed in a flat air-through dryer, as described above in conjunction with the arrangement, within the temperature ranges mentioned above. If utilizing a flat air-through dryer, the pre-bonding step may be dispensed with, cf. above.

As an alternative or a complement, the air-through bonding of step b) may be performed in a cylinder air-through dryer, as described above in conjunction with the arrangement, within the temperature ranges mentioned above. There may also be a combination of pre-bonding and air-through bonding or there may be a sliding scale from pre-bonding to air-through bonding, as also described above.

Preferably step c) is performed at a lower temperature than step b). Thereby, the temperatures of steps b) and c) are preferably selected such that all or substantially all bonding of the web occurs already during step b). The calendering in step c) may then be performed to obtain a preselectable thickness and/or surface finish and/or air permeability of the web.

The method may further comprise sealing the web with at least one seal by at least partially melting the fibres of the second type in the seal. The seal may be longitudinal or transverse and performed in a longitudinal or a transverse sealing unit as described herein. Preferably, the web is both longitudinally and transversely sealed, usually performed as separate steps.

The method may comprise forming the web of the packaging material into individual products by making at least one transverse seal between two consecutive individual products, the transverse sealing preferably being performed by heat-sealing or ultrasonic sealing.

The individual products may further be separated or made separable from each other along a separation line, by a step of separation, e.g. by cutting or perforation, as described in conjunction with describing the arrangement according to the invention. Sealing and separation may be performed as a common step, as e.g. described in WO 2017/093486 A1.

The method may further comprise additional steps of the types known by the skilled person within the field of nonwoven manufacturing. The method may e.g. comprise steps of fine-opening, blending, cross-lapping and/or scrambling. The calendering in step c) may be followed by winding and/or slitting of the web.

BRIEF DESCRIPTION OF THE DRAWINGS

The present invention will hereinafter be further explained by means of non-limiting examples with reference to the appended drawings wherein.

It should be noted that the appended drawings are not necessarily drawn to scale and that the dimensions of some features of the present invention may have been exaggerated for the sake of clarity.

DETAILED DESCRIPTION

The invention will, in the following, be exemplified by embodiments. It should however be realized that the embodiments are included in order to explain principles of the invention and not to limit the scope of the invention, defined by the appended claims. Details from two or more of the embodiments may be combined with each other.

Figure 1:
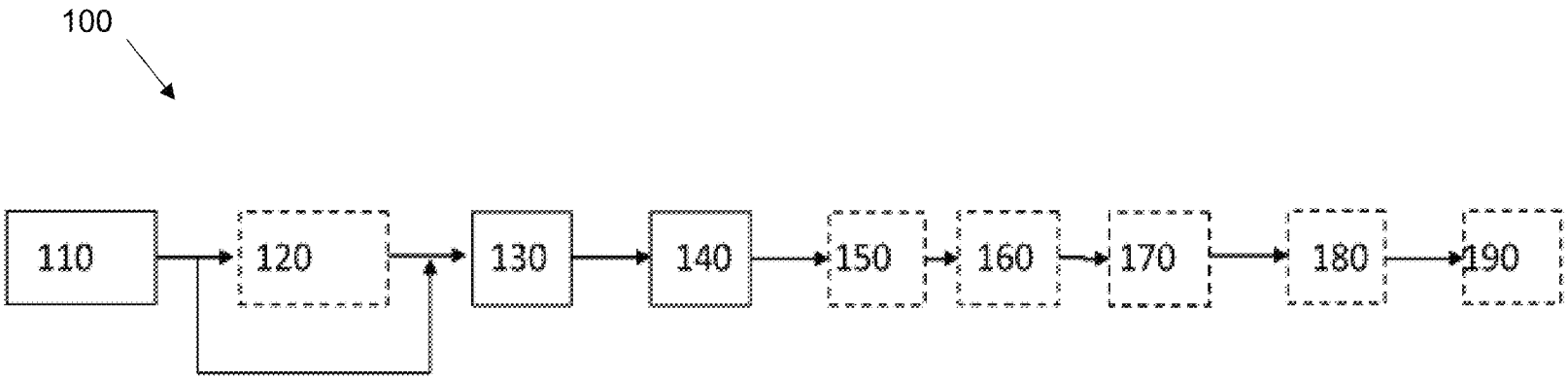
FIG. 1 schematically illustrates an arrangement for manufacturing of a web of packaging material for an oral pouched snuff product according to the invention.

FIG. 1 schematically illustrates an arrangement 100 for manufacturing of a web of packaging material for an oral pouched snuff product according to the invention. The arrangement 100 will be described below following a running direction through it. Dashed lines in FIG. 1 indicate optional units.

The web is a saliva-permeable nonwoven web comprising fibres, whereof 0%-95% are of a first type and 5%-100% of a second type.

The fibres of the first type, which may be dispensed with, are cellulose-based staple fibres, typically man-made fibres, e.g. regenerated cellulose fibres, such as rayon, lyocell or viscose.

The fibres of the second type are thermoplastic fibres, which are meltable and/or softenable at least at the surface at the temperatures used in the arrangement 100. The fibres of the second type may comprise a first component and a second component, wherein second component has a lower melting temperature than said first component. The fibres of the second type may also be mono-component fibres, for which the whole fibre is meltable and/or softenable.

The arrangement 100 comprises a carding unit 110 for carding the fibres of the first type and second type to form a pre-web. Normally the fibres are detached from each other before reaching the carding unit. If utilizing fibres of both the first type and the second type, they are advantageously mixed with each other before being supplied to the carding unit, such that they are carded together.

Downstream of the carding unit 110, the arrangement may comprise a pre-bonding unit 120. Preferably, the pre-bonding unit 120 is configured to blow air through the pre-web at a temperature being within the range of 80° C.-155° C., preferably 90° C.-140° C., more preferably 100° C.-135° C., most preferably 110° C.-130° C. The temperature is selected depending on the melting temperatures of the fibres of the first and second types, such that the temperature in the pre-bonding unit 120 is less than the melting temperatures of the fibres of both the first and second type. The pre-bonding unit 120 is an optional unit which may be dispensed with.

The arrangement 100 further comprises an air-through bonding unit 130 for bonding the pre-web by means of at least partial melting and/or softening of the fibres of the second type to form a web. Thereby the at least partially melted or softened fibres of the second type bind the fibres together to form a cohesive web, such that the bonded web is formed. Hence, there is no need to add an additional binder. If the fibres of the second type are the above-mentioned thermoplastic fibres comprising a first and a second component, the second component partially melts or softens in the air-through bonding unit 130 to bind the fibres together to form a cohesive web.

Figure 2:
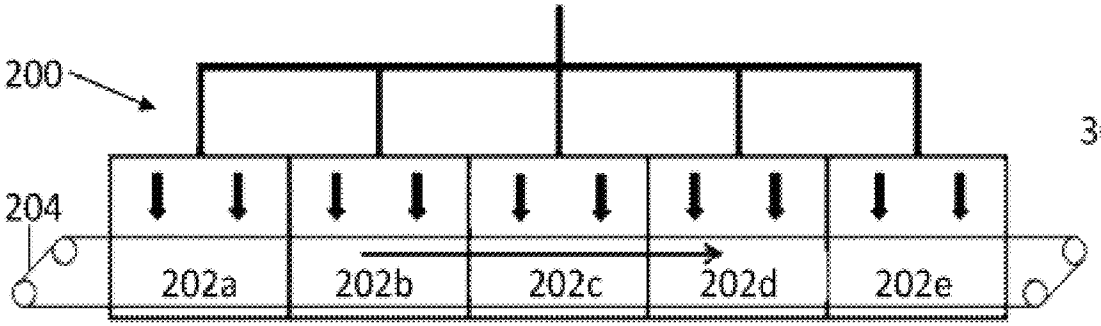
FIG. 2 illustrates a flat air-through dryer.

The air-through bonding unit 130 may comprise or be constituted by a flat air-through dryer 200, e.g. like the one illustrated in FIG. 2. The exemplary flat air-through dryer 200 comprises five zones 202*a-e*, but it would also be feasible with another number of zones, such as a single zone or in the range of from 2 to 10 zones, such as from 3 to 8 zones. The flat air-through dryer 200 is configured to operate at a temperature within the range of 100° C.-160° C., preferably 115° C.-155° C., more preferably 120° C.-150° C., most preferably 130° C.-150° C. If utilizing a flat air-through dryer 200, the pre-bonding unit 120 may be dispensed with. Instead, one or more of the first zones of the flat air-through dryer 200 may be utilized for pre-bonding. There may also be a sliding scale from pre-bonding to air-through bonding.

Figure 3:
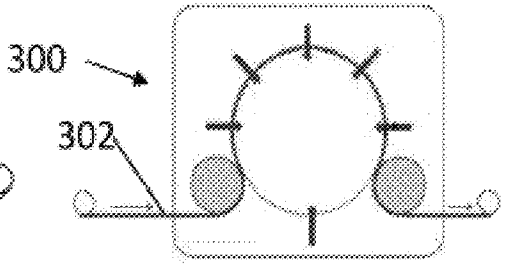
FIG. 3 illustrates a cylinder air-through dryer.

As an alternative or a complement, the air-through bonding unit 130 may comprise or be constituted by a cylinder air-through dryer 300, as illustrated in FIG. 3. The cylinder air-through dryer 300 is configured to operate at a temperature being within the range of 100° C.-160° C., preferably 115° C.-155° C., more preferably 120° C.-150° C., most preferably 130° C.-150° C. The cylinder air-through dryer 300 may advantageously be combined with a pre-bonding unit 120, which is located before, i.e. upstream of, the cylinder air-through dryer 300.

It is also feasible to combine a flat air-through dryer 200 with a cylinder air-through dryer 300, e.g. by utilizing a flat air-through dryer with one zone or a few zones, such as 2-3 zones, followed by the cylinder air-through dryer 300. In that case, one or more of the zones of the flat air-through dryer 200 may be utilized for pre-bonding. There may also be a sliding scale from pre-bonding to air-through bonding.

In order for the cylinder air-through dryer 300 to operate in an appropriate way, the intermediate web 302 should preferably be self-supporting when reaching the cylinder air-through dryer 300, see FIG. 3. In the flat air-through dryer 200 on the other hand, the intermediate web is supported by a machine element, such as a fabric or belt 204, such that also a non-self-supporting web can be handled, see FIG. 2.

After, i.e. downstream of, the air-through bonding unit 130, there is a calendering unit 140 for surface treatment of the web. The calendering is performed to obtain a pre-selectable thickness and/or surface finish and/or air permeability of the web. Hence, in this arrangement, the calendering unit 140 is not utilized to obtain bonding of the web. Instead the web is already sufficiently bonded when reaching the calendering unit 140. The calendering unit 140 may comprise or be constituted by a pair of rollers having smooth surfaces, preferably the rollers having smooth steel surfaces.

The arrangement 100 may further comprise additional units of the types known by the skilled person within the field of nonwoven, not illustrated in FIG. 1. There may e.g. be a fine opener, i.e. a unit for breaking up fibre chunks, before the carding unit 110. The calendering unit 140 may be followed by a winding unit and/or a slitting unit.

The arrangement 100 further comprises a tube-forming unit 150 for forming the web into a tubular structure suitable to enclose a smokeless tobacco composition or non-tobacco composition. The tubular structure has a width suitable for the oral pouched snuff product. The tube-forming unit 150 may e.g. comprise a folding unit folding the web to the tubular structure.

The arrangement 100 of FIG. 1 may further comprise a longitudinal sealing unit 160 for fixing the tubular structure of the web of packaging material into the tubular shape by making at least one longitudinal seal, thus fixing the tubular structure. The longitudinal sealing unit 160 is thus used to make a seal in the above-mentioned tubular structure formed in the tube-forming unit 150. The longitudinal sealing unit 160 may e.g. be a heat-sealing unit or an ultrasonic sealing unit. Thereby the smokeless tobacco composition or non-tobacco composition may be fed into an already formed and sealed tubular structure by a supplying unit 170. Typically, the smokeless tobacco composition or non-tobacco composition is fed as portions of smokeless tobacco composition or non-tobacco composition.

In the longitudinal sealing unit 160, energy is applied to create a seal in the nonwoven web by at least partial melting of the fibres of the second type. If the fibres of the second type are fibres as mentioned above comprising a first and a second component, at least the second component melts, and preferably both the first and the second component melts. The seal is preferably located outside the smokeless tobacco composition or non-tobacco composition, such that the seal is formed between two nonwoven surfaces being placed surface to surface in relation to each other.

In the illustrated embodiment, the tube-forming unit 150 and the longitudinal sealing unit 160 are located before, i.e. upstream of the supplying unit 170, such that the smokeless tobacco composition or non-tobacco composition is fed into an already formed tubular structure by the supplying unit 170.

In an alternative arrangement, the supplying unit 170 may be located before the tube-forming unit 150 and the longitudinal sealing unit 160, such that the smokeless tobacco composition or non-tobacco composition, e.g. as portions, first is placed on the web and thereafter the tubular structure is formed around the smokeless tobacco composition or non-tobacco composition. The web may e.g. be longitudinally folded around the smokeless tobacco composition or non-tobacco composition.

The arrangement 100 may further comprise a transverse sealing unit 180 for forming the web of packaging material into individual products by making at least one transverse seal between two consecutive individual products formed by the web.

The individual products may also be separated or made separable from each other along a separation line, e.g. by cutting or perforation in a separation unit 190. The transverse sealing unit 180 may be a heat-sealing unit or an ultrasonic sealing unit, like the type of sealing units described above for the longitudinal sealing unit 160. The separation unit 190 may be combined with the transverse sealing unit 180, e.g. if using the same ultrasonic unit both for sealing and separating as is disclosed in WO 2017/093486 A1.

Figure 4:
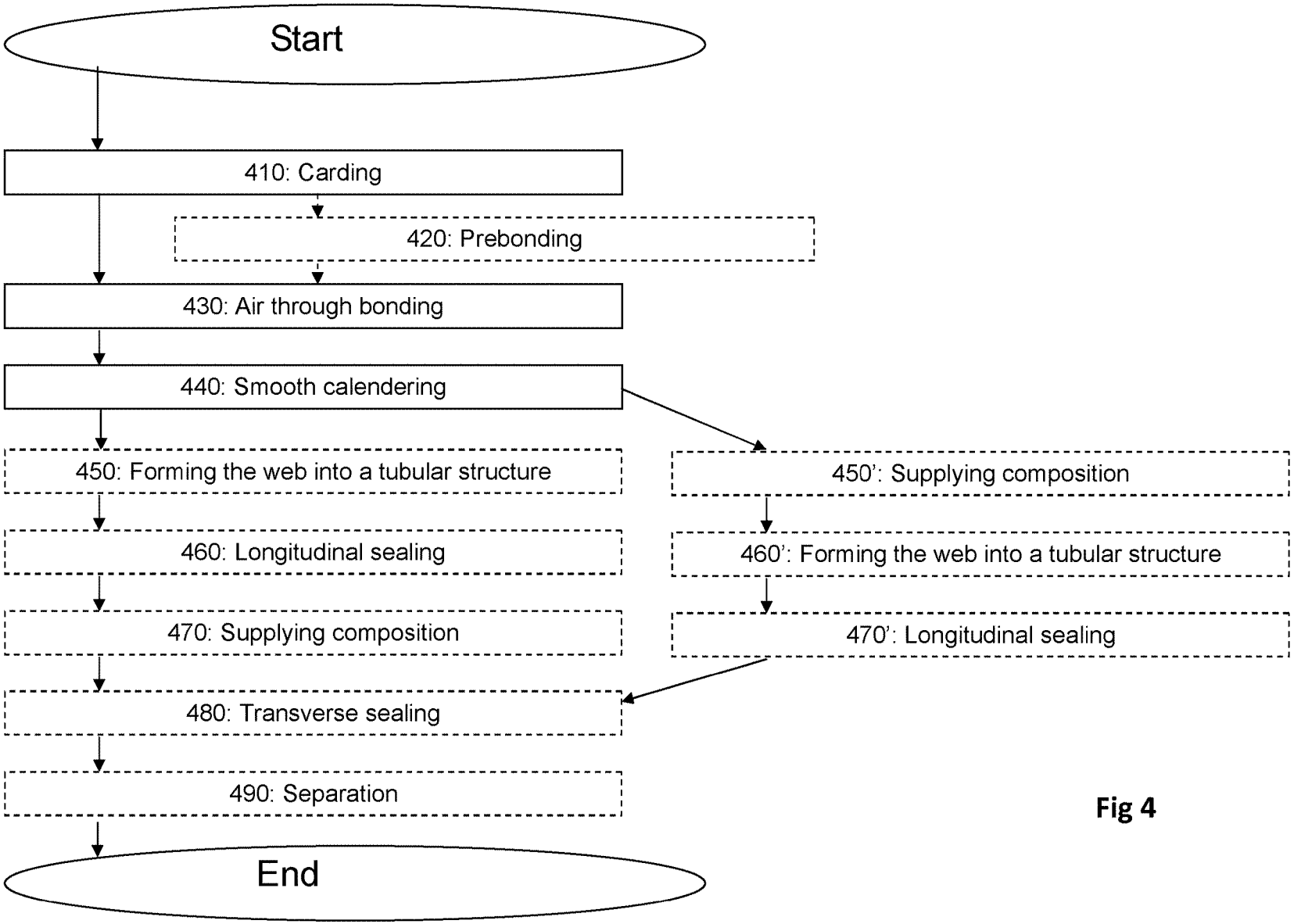
FIG. 4 illustrates a method according to the invention.

FIG. 4 schematically illustrates a method 400 for manufacturing of a web of packaging material for an oral pouched snuff product according to the invention. The method 400 is suitable to be performed in an arrangement 100 as described herein. In that case the steps of the method correspond to the various units of the arrangement 100. Dashed lines in FIG. 4 indicate optional steps.

The web to be manufactured by the method is a saliva-permeable nonwoven web comprising fibres, whereof 0%-95% are of a first type and 5%-100% of a second type. The fibres of the first type, which may be dispensed with are cellulose-based staple fibres. The fibres of the second type are thermoplastic fibres, which are meltable and/or softenable at least at the surface, e.g. thermoplastic fibres comprising a first component and a second component, wherein second component has a lower melting temperature than said first component.

The method comprises the steps of:

410: Carding the fibres to form a pre-web.

430: Bonding the pre-web by blowing air through the pre-web to at least partially melt and/or soften the fibres of the second type to form the web of packaging material.

440: Smooth calendering of the web.

In case the fibres of the second type are thermoplastic fibres comprising a first component and a second component as described above, wherein the second component has a lower melting temperature than the first component, step 430 preferably comprises bonding the web by at least partially melting and/or softening of the second component of the fibres of the second type.

The method 400 may comprise an optional step:

420: Pre-bonding the pre-web formed by carding in step 410.

The pre-bonding of step 420 is performed before the step 430 of air-through bonding. The step 420 of pre-bonding may be performed in a pre-bonding unit 120 configured to blow air through the pre-web, please see the description of FIG. 1. The pre-bonding of step 420 may be performed at a temperature being within the range of 80° C.-155° C., preferably 90° C.-140° C., more preferably 100° C.-135° C., most preferably 110° C.-130° C. The temperature interval is selected dependent on the melting temperatures of the fibres of the first and second types, such that the temperature in the pre-bonding step 420 is less than their respective melting temperatures. Moreover, the pre-bonding step 420 is an optional step which may be dispensed with.

The calendering of step 440 is preferably performed at a lower temperature than the air-through bonding of step 430. More preferably, the temperatures of steps 430 and 440 are selected such that all bonding or substantially all bonding of the web occurs already during step 430. The calendering in step 440 may then be performed to obtain a pre-selectable thickness and/or surface finish and/or air permeability of the web.

In the air-through bonding of step 430, the fibres of the second type melt or soften and bind the fibres together to form a cohesive web, such that the web is formed. If the fibres of the second type are the above-mentioned thermoplastic fibres comprising a first and a second component, the second component partially melts or softens to bind the fibres together to form a cohesive web.

The air-through bonding of step 430 may be performed in a flat air-through dryer 200, e.g. as illustrated in FIG. 2. In that case the air-through bonding of step 430 may be performed at a temperature within the ranges mentioned above. If utilizing a flat air-through dryer 200, the pre-bonding step 420 may be dispensed with, cf. above.

As an alternative or a complement, the air-through bonding of step 430 may be performed in a cylinder air-through dryer 300, e.g. as illustrated in FIG. 3. In that case the air-through bonding of step 430 may be performed at a temperature within the ranges mentioned above.

There may also be a combination of pre-bonding and air-through bonding or there may be a sliding scale from pre-bonding to air-through bonding, which is also described above, e.g. in conjunction with FIG. 1.

The method 400 may further comprise one or more of the following optional steps:

450: Forming the web into a tubular structure.

460: Longitudinal sealing

470: Supplying smokeless tobacco composition or non-tobacco composition

480: Transverse sealing

490: Separation

Step 450 may be performed by means of a tube-forming unit 150, which forms at least one tubular structure of the web, e.g. by folding, which tubular structure has a width suitable for the oral pouched snuff product.

The tube-forming unit 150 may be located before the supplying unit 170, as is in the method illustrated to the left in FIG. 4, such that the smokeless tobacco composition or non-tobacco composition later on, e.g. as portions, is fed into an already formed tubular structure by the supplying unit 170, see step 470 below.

The method 400 of FIG. 1 further comprises an optional step of sealing the web with at least one seal by at least partially melting the fibres of the second type in the web at the location where the seal is formed. The sealing may be a longitudinal sealing, as in step 460 or a transverse sealing, as in step 480, but typically sealing is first performed in the longitudinal direction and thereafter in the transverse direction, i.e. by performing steps 460 and 480.

The step 460 of longitudinal sealing results in fixing the web of packaging material into a tubular shape by making at least one longitudinal seal. The longitudinal sealing 460 is thus performed to make a seal and thereby fix the above-mentioned tubular structure. The longitudinal sealing 460 may be performed by heat-sealing or ultrasonic sealing as described above. During sealing, energy is applied to create a seal in the nonwoven. The seal is preferably located outside the smokeless tobacco composition or non-tobacco composition, such that the seal is formed between two nonwoven surfaces being placed surface to surface in relation to each other. In the method depicted to the left in FIG. 4, the step 460 of longitudinal sealing is performed before the step 470, such that the smokeless tobacco composition or non-tobacco composition is fed into an already formed and sealed tubular structure.

As an alternative, the tube-forming unit 150 may be located after the supplying unit, such that step 450' of supplying smokeless tobacco composition or non-tobacco composition is performed before step 460' of forming the web into a tubular structure, see method depicted to the right in FIG. 4. The smokeless tobacco composition or non-tobacco composition is then first placed on the web, typically as portions, and thereafter the tubular structure is formed around the smokeless tobacco composition or non-tobacco composition. The web may e.g. be longitudinally folded around the smokeless tobacco composition or non-tobacco composition. Step 460' is thereafter followed by the step 470' of longitudinal sealing.

As an alternative or a complementary way to the folding the web into a tubular structure, a second saliva-permeable nonwoven web may be positioned on top of a first saliva-permeable nonwoven web such that one or more tubular structures are formed between the two webs as described above. In that case, the step of supplying the smokeless tobacco composition or non-tobacco composition may be made either before or after forming the tubular structure, i.e. it would be feasible to follow either steps 450 to 470 depicted to the left or steps 450' to 470' depicted to the right.

There would then be a longitudinal seal at either longitudinal side of the smokeless tobacco composition or non-tobacco composition.

The method 400 may further comprises a step 480 of transverse sealing for forming the web of packaging material into individual products by making at least one transverse seal between two of the individual products. The transverse sealing may be performed by a heat-sealing or an ultrasonic sealing, e.g. in the transverse sealing unit 180 described above.

The individual products may also be separated or made separable from each other along a separation line, by a step 490 of separation, e.g. by cutting or perforation, as described above when describing the arrangement 100. Transverse sealing 480 and separation 490 may be performed as a common step.

Further modifications of the invention within the scope of the appended claims are feasible. As such, the present invention should not be considered as limited by the embodiments and figures described herein. Rather, the full scope of the invention should be determined by the appended claims, with reference to the description and drawings.

The invention claimed is:

1. An arrangement for manufacturing of a web of packaging material for an oral pouched snuff product, said web being a saliva-permeable nonwoven web comprising fibres of a first type and of a second type, said arrangement comprising:

a first fibre supply unit for supplying said fibres of said first type, said fibres of said first type being cellulose-based staple fibres, and a second fibre supply unit for supplying said fibres of said second type, said fibres of said second type being thermoplastic fibres, which are meltable and/or softenable at least at a surface of said fibres of said second type, a carding unit for carding said fibres of said first type and said second type to form a pre-web, an air-through bonding unit for bonding said pre-web by means of at least partial melting and/or softening of said fibres of said second type to form a bonded web, said air-through bonding unit comprising or being constituted by a flat air-through dryer and/or a cylinder air-through dryer, a calendering unit for surface treatment of said web by smooth calendering, wherein said calendering unit is configured to receive said web following bonding of said web by said air-through bonding unit, said calendering unit being configured to operate at a surface treatment temperature being within the range of 55° C.-70° C., wherein said calendering unit comprises a pair of rollers having smooth surfaces, wherein the calendering unit is configured to obtain a pre-selectable thickness and/or surface finish and/or air permeability of the web.

2. The arrangement according to claim 1, said flat air-through dryer being configured to blow air through said pre-web at a temperature being within the range of 100° C.-160° C.

3. The arrangement according to claim 1, said cylinder air-through dryer being configured to blow air through said pre-web at a temperature being within the range of 100° C.-160° C.

4. The arrangement according to claim 1, further comprising a pre-bonding unit being located before said air-through bonding unit.

5. The arrangement according to claim 1, wherein said calendering unit is configured to operate at a pressure being within a range of 5-70 kg/cm$^2$.

6. The arrangement according to claim 1, further comprising a supplying unit for supplying a smokeless tobacco composition or non-tobacco composition to said web, and a tube-forming unit for forming said web into a tubular structure, said tube-forming unit being located before or after said supplying unit.

7. The arrangement according to claim 1, further comprising a longitudinal sealing unit for fixing said web of packaging material into a tubular shape by making at least one longitudinal seal.

8. The arrangement according to claim 1, further comprising a transverse sealing unit for forming said web of packaging material into individual products by making at least one transverse seal between two of said individual products.

9. The arrangement of claim 1, wherein the first and second fibre supply units are configured to cooperate to supply the fibers of the first and second types, respectively, to form the web to have 5%-50% of the first type and 50-95% of the second type.

10. The arrangement of claim 1, wherein said calendering unit is configured not to bond the web over an entire area of the web.

11. A method for manufacturing of a web of packaging material for an oral pouched snuff product, said web being a saliva-permeable nonwoven web comprising fibres in the arrangement according to claim 1, whereof said fibres are of the first type and the second type, said method comprising:

a1) supplying said fibres of said first type by the first fibre supply unit, said fibres of said first type being cellulose-based staple fibres, a2) supplying said fibres of said second type by the second fibre supply unit, said fibres of said second type being thermoplastic fibres, which are meltable and/or softenable at least at the surface, a) carding said fibres of said first type and said second type to form a pre-web, b) bonding said pre-web by blowing air through said pre-web to at least partially melt and/or soften said fibres of said second type to form said web of packaging material, and c) smooth calendering of said web for surface treatment of said web, following bonding of said pre-web, in the calendering unit operating at a surface treatment temperature being within the range of 55° C.-70° C. without bonding the web, wherein smooth calendering comprises passing said web between the pair of rollers having smooth surfaces.

12. The method according to claim 11, wherein said fibres of said second type are thermoplastic fibres comprising a first component and a second component, said second component having a lower melting temperature than said first component, wherein step b) of said method comprises bonding said web by at least partially melting and/or softening of said second component of said fibres of said second type.

13. The method according to claim 11, wherein step c) is performed at a lower temperature than step b).

14. The method according to claim 11, wherein said calendering in step c) is performed to obtain a preselectable thickness and/or surface finish and/or air permeability of said web.

15. The method according to claim 11, further comprising sealing said web with at least one seal by at least partially melting said fibres of said second type in said seal.

16. The method according to claim 11, further comprising forming said web of packaging material into individual products by making at least one transverse seal between two of said individual product.

17. The method of claim 11, wherein supplying said fibres of said first and second types comprises supplying said fibres at a proportion of 5%-50% of the first type and 50-95% of the second type.

18. The method of claim 11, wherein the web is not bonded by calendering over an entire area of the web.

* * * * *